US007328686B2

(12) United States Patent
Cullen

(10) Patent No.: US 7,328,686 B2
(45) Date of Patent: Feb. 12, 2008

(54) SYSTEM AND METHOD TO CONTROL CYLINDER ACTIVATION AND DEACTIVATION

(75) Inventor: Michael J. Cullen, Northville, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 450 days.

(21) Appl. No.: 10/670,170

(22) Filed: Sep. 23, 2003

(65) Prior Publication Data

US 2005/0065709 A1 Mar. 24, 2005

(51) Int. Cl.
*F02D 17/02* (2006.01)
*F02D 41/12* (2006.01)

(52) U.S. Cl. ..... 123/325; 123/198 F; 123/436; 123/481; 123/493; 701/112

(58) Field of Classification Search ..... 123/198 F, 123/320, 325, 436, 481, 493; 180/197; 701/90, 701/110, 112
See application file for complete search history.

(56) References Cited

U.S. PATENT DOCUMENTS

| | | | | |
|---|---|---|---|---|
| 4,467,602 | A | 8/1984 | Iizuka et al. | 60/276 |
| 4,515,121 | A | 5/1985 | Matsuura et al. | 123/198 F |
| 5,099,816 | A | 3/1992 | Ohga et al. | 123/481 |
| 5,241,855 | A | 9/1993 | Cullen et al. | 73/117.3 |
| 5,267,541 | A | 12/1993 | Taguchi et al. | 123/198 F |
| 5,337,715 | A * | 8/1994 | Gonzales et al. | 123/325 |
| 5,351,776 | A | 10/1994 | Keller et al. | 701/70 |
| 5,368,000 | A | 11/1994 | Koziara | 123/481 |
| 5,492,094 | A | 2/1996 | Cullen et al. | 123/339.11 |
| 5,540,633 | A | 7/1996 | Yamanaka et al. | 477/107 |
| 5,558,178 | A | 9/1996 | Hess et al. | 180/197 |
| 5,562,086 | A | 10/1996 | Asada et al. | 123/568.21 |
| 5,579,736 | A | 12/1996 | Nakamura et al. | 123/339.11 |
| 5,584,266 | A | 12/1996 | Motose et al. | 123/73 A |
| 5,617,829 | A | 4/1997 | Bidner et al. | 123/481 |
| 5,657,230 | A | 8/1997 | Hess et al. | 701/104 |
| 5,669,357 | A | 9/1997 | Denz et al. | 123/481 |
| 5,673,668 | A | 10/1997 | Pallett et al. | 123/436 |
| 5,762,043 | A | 6/1998 | Yoshioka et al. | 123/325 |
| 5,797,371 | A | 8/1998 | Nonaka | 123/481 |
| 5,839,409 | A * | 11/1998 | Denz et al. | 123/326 |
| 5,941,211 | A | 8/1999 | Brehob et al. | 123/325 |
| 5,941,925 | A | 8/1999 | Hess et al. | 701/91 |
| 6,039,023 | A | 3/2000 | Cullen et al. | 123/339.23 |
| 6,109,236 | A | 8/2000 | Takahashi et al. | 123/339.19 |
| 6,178,371 | B1 | 1/2001 | Light et al. | 701/93 |
| 6,250,282 | B1 | 6/2001 | Osaki et al. | 123/339.14 |
| 6,263,856 | B1 | 7/2001 | Weber et al. | 123/352 |
| 6,468,183 | B1 | 10/2002 | O'Neil et al. | 477/107 |
| 6,506,140 | B1 | 1/2003 | O'Neil et al. | 477/62 |
| 6,516,778 | B1 | 2/2003 | Light et al. | 123/352 |
| 6,536,414 | B2 * | 3/2003 | Hasegawa et al. | 123/493 |
| 2002/0116112 | A1 * | 8/2002 | Wakashiro et al. | 701/110 |

* cited by examiner

*Primary Examiner*—T. M Argenbright
(74) *Attorney, Agent, or Firm*—Allan J. Lippa; Alleman Hall McCoy Russell & Tuttle LLP

(57) ABSTRACT

Engine cylinder reactivation from a fuel-cut state is controlled based on a calculated future engine speed and a minimum allowable engine speed. The future engine speed is calculated based on the current rate of change of engine speed and a duration required to reactivate an engine cylinder. The duration can be in the time domain, or engine event domain, for example.

19 Claims, 6 Drawing Sheets

SYSTEM AND METHOD TO CONTROL CYLINDER ACTIVATION AND DEACTIVATION

BACKGROUND OF THE INVENTION

In vehicles having internal combustion engines, it can be beneficial to discontinue fuel injection to all or some of the engine cylinders during certain operating conditions, such as during vehicle deceleration or braking. The greater the number of cylinder deactivated, or the longer cylinders are deactivated, the greater the fuel economy that can be achieved. It is known to consider a variety of factors for enabling cylinder deactivation, including: whether engine speed error is greater than a threshold value; the gear ratio of the transmission; whether vehicle speed is greater than a threshold value, whether engine load is greater than a threshold value, and whether the throttle is closed greater than a threshold value, as described in FIGS. 3A-3B below.

The inventors herein, however, have recognized a disadvantage that can be encountered when deactivating fuel injection to engine cylinders. Specifically, engine stalls can occur when trying to re-enable deactivated cylinders depending on engine speed. Further, it takes a certain duration (e.g., amount of time, or number of engine cycles) to re-enable engine firing. Thus, the inventors herein have recognized that if the cylinder deactivation condition is allowed to exist in certain conditions, then during reactivation of the cylinders it is possible that an engine stall can occur. This results in under-utilization of cylinder disablement (fuel cut-out operation) and therefore unrealized fuel economy gains.

SUMMARY OF THE INVENTION

The above disadvantage can be overcome by a method for controlling an engine of a powertrain in a vehicle on the road, the method comprising:

deactivating fuel injection to at least one engine cylinder based at least on a vehicle operating condition;

determining a duration required for reactivating at least said at least one engine cylinder; and reactivating at least said at least one engine cylinder based at least on said duration.

By considering the duration required for reactivating at least said engine cylinders and a minimum speed value, it is possible to reactivate engine cylinders under conditions that reduce any engine stalls. In one example, it is possible to predict a future engine speed based on the required reactivation time, and then use this predicted speed to prevent the engine from falling below a minimum allowable speed value. In another example, a table of engine speed limits can be generated as a function of required reactivation time and rate of change of engine speed. Various other examples can also be used.

Note that the duration required for reactivation can be in various forms. For example, an amount of time required for reactivation can be used. Alternatively, a number of engine cycles required for reactivation can be used. Still other example, such as a combination of time and cylinder events can be used. Also note that in the examples using a minimum engine speed, it can be a fixed value, or a variable one calculated and adjusted during vehicle operation.

In another aspect, the above disadvantages can be overcome by a computer storage medium having instructions encoded therein for controlling an engine of a powertrain in a vehicle on the road, said medium comprising:

code for deactivating fuel injection to at least one engine cylinder based at least on a vehicle operating condition;

code for determining a duration required for reactivating at least said at least one engine cylinder;

code for determining a rate of change of engine speed; and reactivating at least said at least one engine cylinder based at least on said rate of change of engine speed and said duration.

By utilizing the required duration for reactivation, along with the rate of change of engine speed, it is possible to accurately determine when reactivation should be scheduled. Note also that it is possible to simply use a determined rate of change to reactivate cylinders.

As such, it is possible to maximize cylinder deactivation, while at the same time reduce engine stalls during reactivation. The result is improved customer satisfaction due to increased fuel economy and reliability.

Further, the inventors herein have also recognized that several factors have a significant impact on the required duration for cylinder reactivation and at what engine speed reactivation may result in engine stalls. One example is whether an engine braking condition exists. For example, engine braking can exist when using an automatic transmission in which the current gear mechanically links the engine to the vehicles wheels, and thus the road, thereby allowing the wheels to drive the engine. As another example, engine braking is absent when a manual transmission clutch is engage, or when an overrunning clutch is present in certain gears of an automatic transmission. The inventors herein have thus recognized that in the non-engine braking conditions, the engine is more likely to be susceptible to engine stalls upon reactivation since the engine is not being driven via the vehicles' wheels.

BRIEF DESCRIPTION OF THE DRAWINGS

The advantages described herein will be more fully understood by reading examples of embodiments in which the invention is used to advantage, with reference to the drawings, wherein.

DESCRIPTION OF EXAMPLE EMBODIMENT(S)

Figure 1:
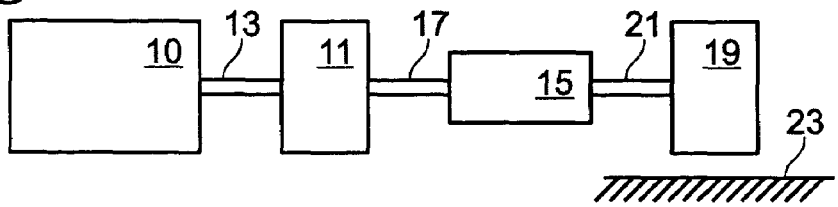
FIG. 1 is a block diagram of a vehicle powertrain illustrating various components related to the present invention.
Figure 2:
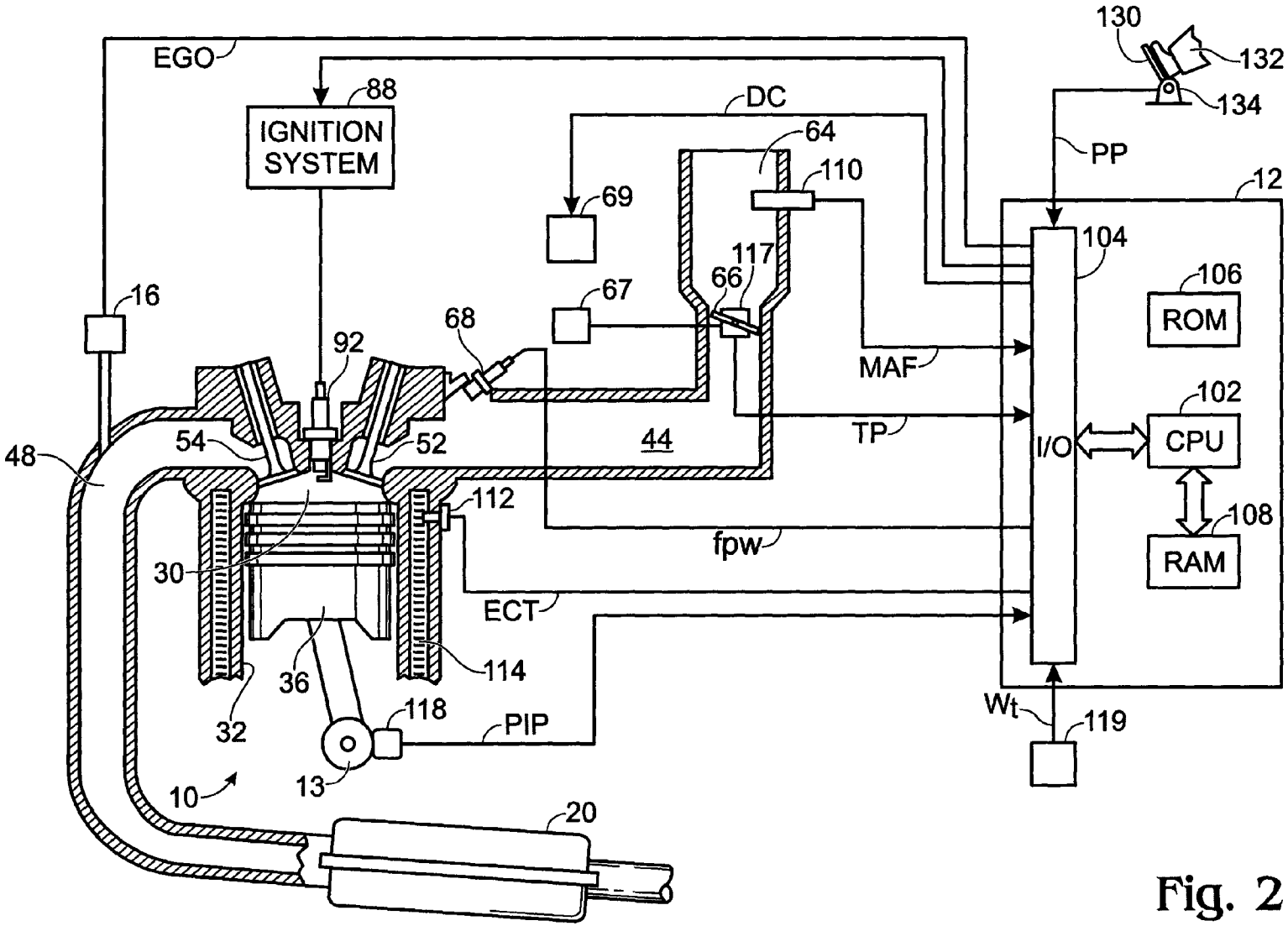
FIG. 2 is a block diagram of an engine in which the invention is used to advantage.

Referring to FIG. 1, internal combustion engine 10, further described herein with particular reference to FIG. 2, is shown coupled to torque converter 11 via crankshaft 13. Torque converter 11 is also coupled to transmission 15 via turbine shaft 17. Torque converter 11 has a bypass clutch (not shown) which can be engaged, disengaged, or partially engaged. When the clutch is either disengaged or partially engaged, the torque converter is said to be in an unlocked state. Turbine shaft 17 is also known as transmission input shaft. Transmission 15 comprises an electronically controlled transmission with a plurality of selectable discrete gear ratios. Transmission 15 also comprise various other gears, such as, for example, a final drive ratio (not shown). Transmission 15 is also coupled to tire 19 via axle 21. Tire 19 interfaces the vehicle (not shown) to the road 23.

Internal combustion engine 10 comprising a plurality of cylinders, one cylinder of which is shown in FIG. 2, is controlled by electronic engine controller 12. Engine 10 includes combustion chamber 30 and cylinder walls 32 with piston 36 positioned therein and connected to crankshaft 13.

Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of turbine speed (Wt) from turbine speed sensor 119, where turbine speed measures the speed of shaft 17, and a profile ignition pickup signal (PIP) from Hall effect sensor 118 coupled to crankshaft 13 indicating and engine speed (N).

Continuing with FIG. 2, accelerator pedal 130 is shown communicating with the driver's foot 132. Accelerator pedal position (PP) is measured by pedal position sensor 134 and sent to controller 12.

In an alternative embodiment, where an electronically controlled throttle is not used, an air bypass valve (not shown) can be installed to allow a controlled amount of air to bypass throttle plate 62. In this alternative embodiment, the air bypass valve (not shown) receives a control signal (not shown) from controller 12.

As will be appreciated by one of ordinary skill in the art, the specific routines described below in the flowcharts may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the invention, but is provided for ease of illustration and description. Although not explicitly illustrated, one of ordinary skill in the art will recognize that one or more of the illustrated steps or functions may be repeatedly performed depending on the particular strategy being used. Further, these Figures graphically represent code to be programmed into the computer readable storage medium in controller 12.

Figure 3A:
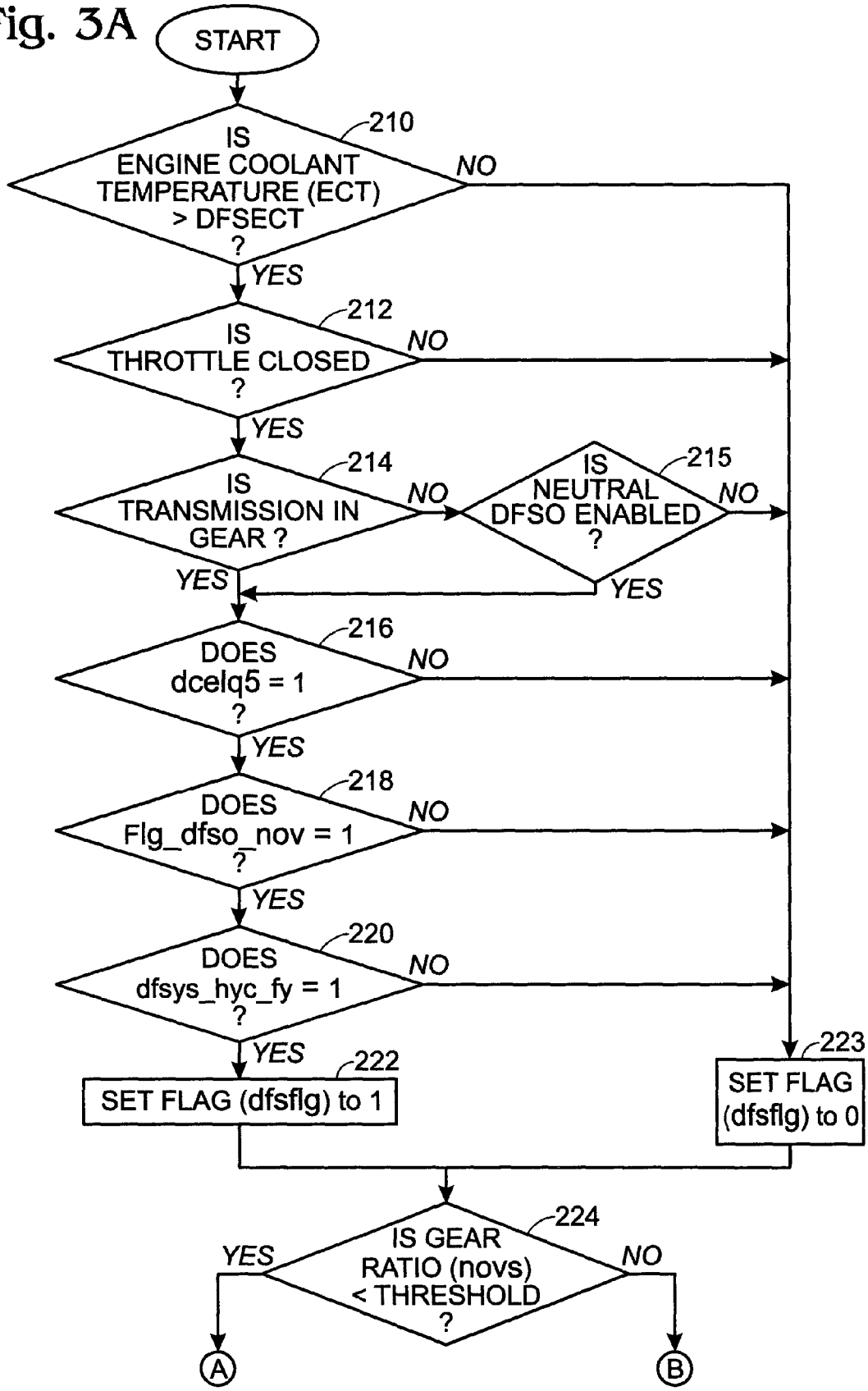
Figure 3B:
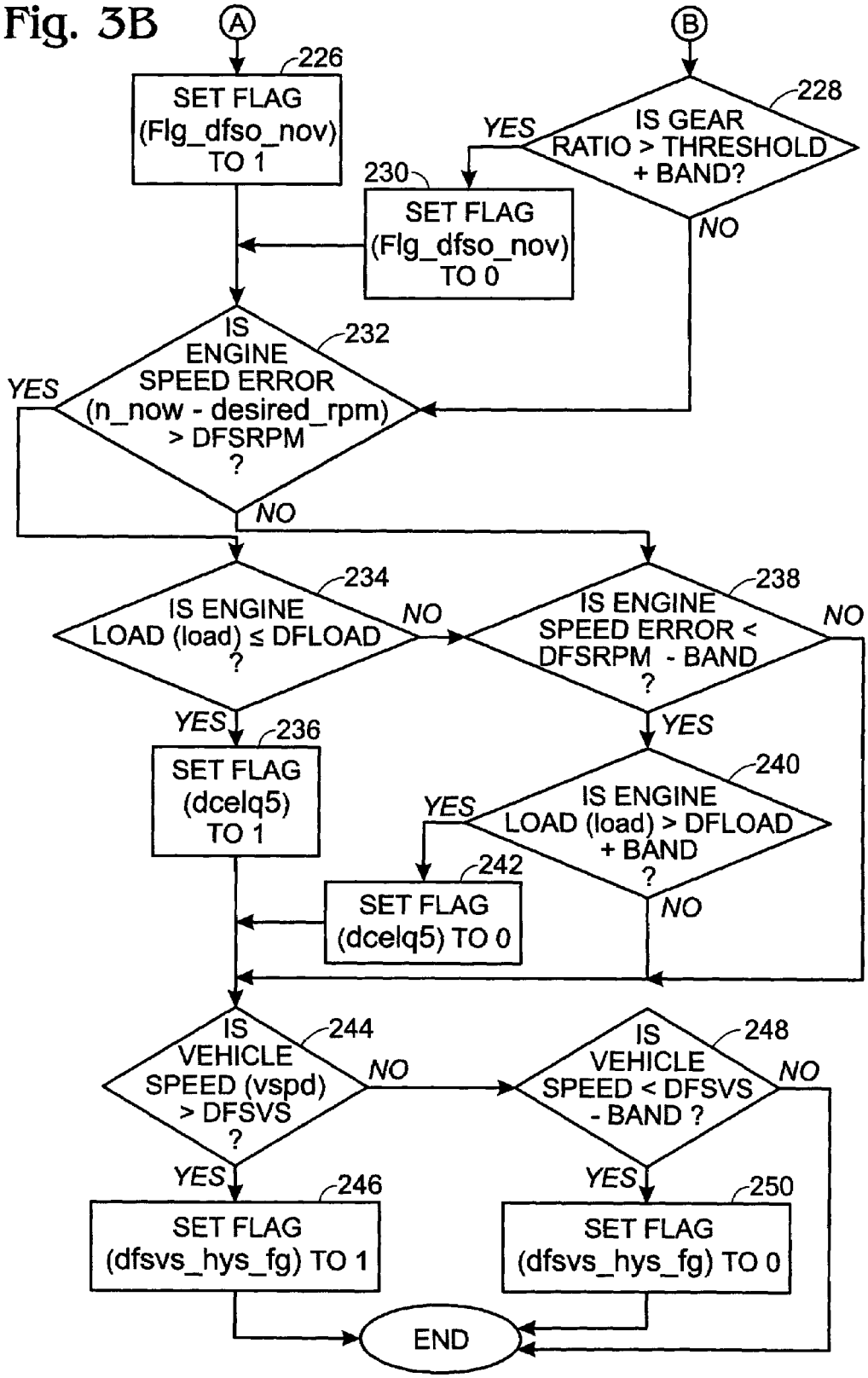

Referring now to FIGS. 3A-3B, a routine is described for enabling and controlling fuel cut operation. First, in step 210, the routine determines whether engine coolant (ECT) is greater than a threshold temperature to enable cylinder deactivation (DFSECT). For example, the routine determined whether the engine is in a warmed up state in which fuel cut operation is allowed.

Next, in step 212, the routine determines whether the throttle is closed greater than a threshold amount. Then, in step 214, the routine determine whether the transmission is in gear. If not, in step 215, the routine determines whether cylinder deactivation in neutral is enabled.

Then, in step 216, the routine checks whether the flag (dcelq5) is equal to one. This flag is described in more detail below with regard to steps 232 to 242 and determines generally whether the engine load and engine speed are high enough to enable fuel cut operation.

Continuing, in step 218, the routine checks flag (flg_dfso_nov) which is described in more detail below with regard to steps 224-230 and determines generally whether the transmission is in a high enough gear.

Then, in step 220, the routine sets the flag (dfsflg) to one, or in step 223 sets the flag to zero depending on the determinations of steps 210 to 218.

Continuing with FIGS. 3A-3B, in step 224, the routine determines whether the gear ratio (novs—engine speed over vehicle speed) is less than a threshold value. If so, the routine sets the flag (flg_dfso_nov) to one in step 226. Otherwise, the routine determines whether the gear ratio (novs—engine speed over vehicle speed) is greater than the threshold value plus a band to prevent hunting (e.g., a hysteresis band) in step 228. If so, the routine sets the flag (flg_dfso_nov) to zero in step 230.

Next, in step 232, the routine determines whether engine speed error (n_now—desired_rpm) is greater than a threshold (DFSRPM), and if so, determine whether engine load (load) is greater to the limit (DFLOAD) in step 234. If so, the routine sets the flag (dcelq5) to one in step 236. Otherwise, in step 238, the routine determines whether engine speed error is less than a threshold (DFSRPM) minus hysteresis band, and if so, determine whether engine load (load) is less than the limit (DFLOAD) plus hysteresis band in step 240. If so, the routine sets the flag (dcelq5) to zero in step 242. In this way, the routine determines whether engine speed is high enough and load low enough to enable fuel cut operation.

Next, in step 244, the routine determines whether vehicle speed (vspd) is greater than a threshold speed (DFSVS). If so, in step 246, the routine sets the flag (dfsvs_hys_fg) to one. Otherwise, in step 248, the routine determines whether vehicle speed is less than the threshold speed (DFSVS) minus a hysteresis band. If so, in step 250, the routine sets the flag (dfsvs_hys_fg) to zero. In this way, the routine determines whether vehicle speed is high enough to enable fuel cut operation.

Figure 4:
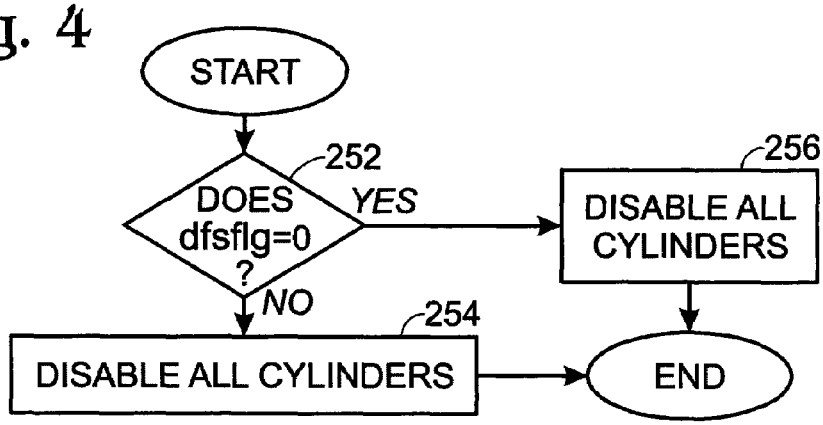
FIGS. 3A-3B, 4 and 5 are exemplary routines for controlling fuel cut out operation.
Figure 7:
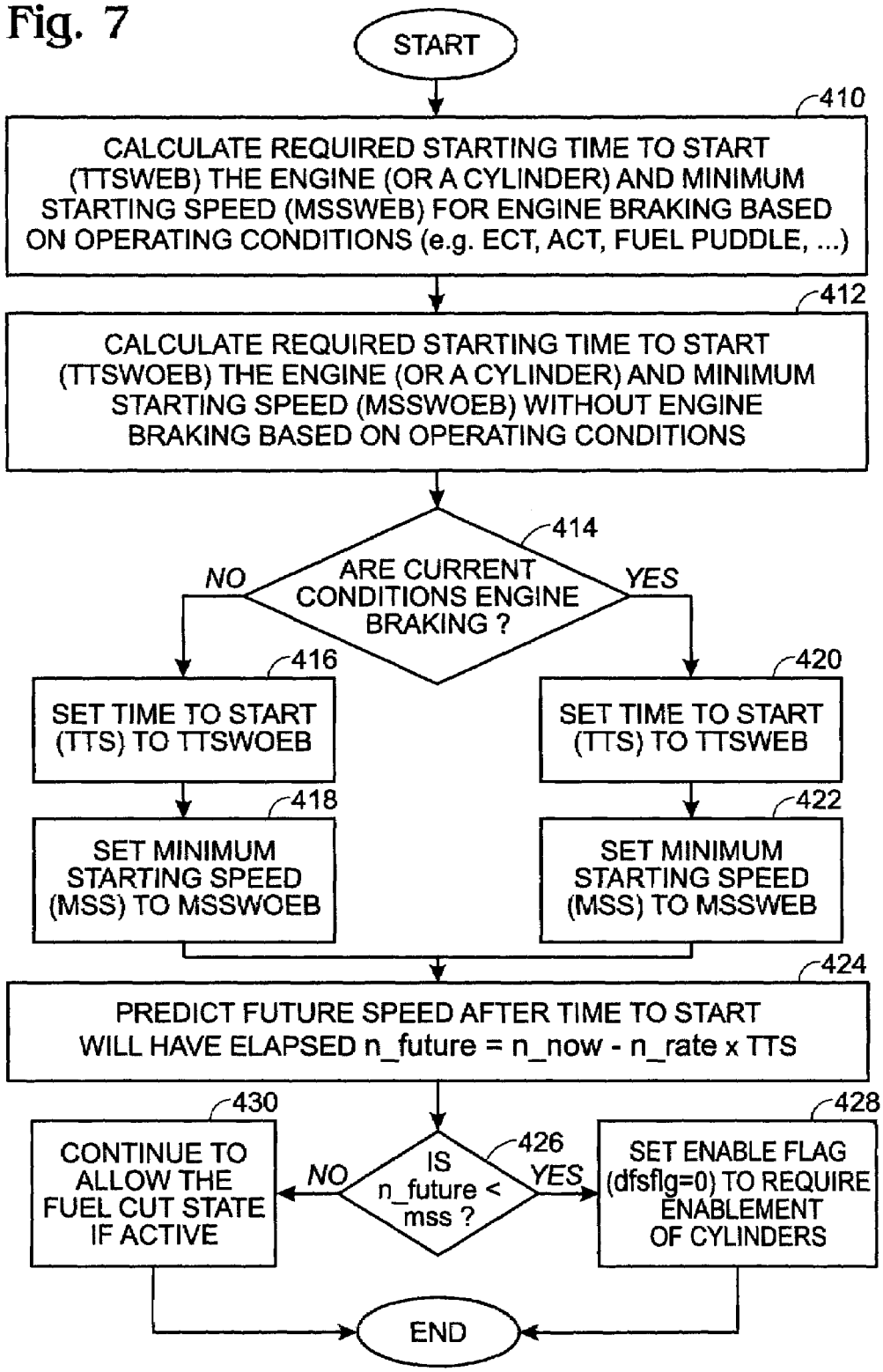

In FIG. 4, the routine utilize the flags as set in FIGS. 3A-3B, as well as set in step 428 of FIG. 7, to determine whether to enable or disable fuel injection to all cylinders of engine 10. Specifically in step 252, the routine checks flag (dfsflg). If it is set to zero, all cylinders are enabled in step 256. Otherwise, all cylinders are disabled in step 254.

In an alternative embodiment, enablement and disablement of cylinders is based on a desired engine torque, and a minimum torque that can be produced by combustion in the engine cylinders. In general terms, the cylinders are individually enabled and disabled to provide a desired engine torque. Further, adjustment to spark advance and air-fuel ratio can be used to provide a continuously adjustable engine torque to low levels (i.e., that which can be provided by a single cylinder at the lean air-fuel limit and maximum ignition timing retard, and as low as all cylinder deactivated. In this alternative embodiment, FIGS. 3A-3B and 4 are substituted with a torque control structure that determines a desired engine torque based on a desired wheel torque. The desired wheel torque can be determined based on a map of vehicle speed and pedal position. However, the routine of FIG. 7 is still utilized to provide reactivation that can reduce engine stalls.

Referring now to FIG. 2, a block diagram illustrating various components or modules of the control logic, along with associated outputs, is shown. As one of ordinary skill in the art will appreciate, the various functions or operations shown in FIGS. 3A-3*b*, 4 and 5 may be performed by software, hardware, or a combination of hardware and software. Furthermore, the particular order of operations and functions illustrated may not be necessary to accomplish the objects and advantages according to the present invention. In general, sequential operation is shown for ease of illustration only. As such, various processes and strategies may be used depending upon the particular application, including multi-tasking, interrupt (time) driven, event driven, or parallel computing strategies may be used to implement the illustrated control logic. Similarly, one of ordinary skill will in the art may recognize various equivalent implementations in hardware and/or software to accomplish the objects and advantages of the present invention. In a preferred embodiment of the present invention, the functions illustrated in FIGS. 3A-3B, 4 and 5 are implemented primarily as software within a controller such as ECM 76.

Figure 5:
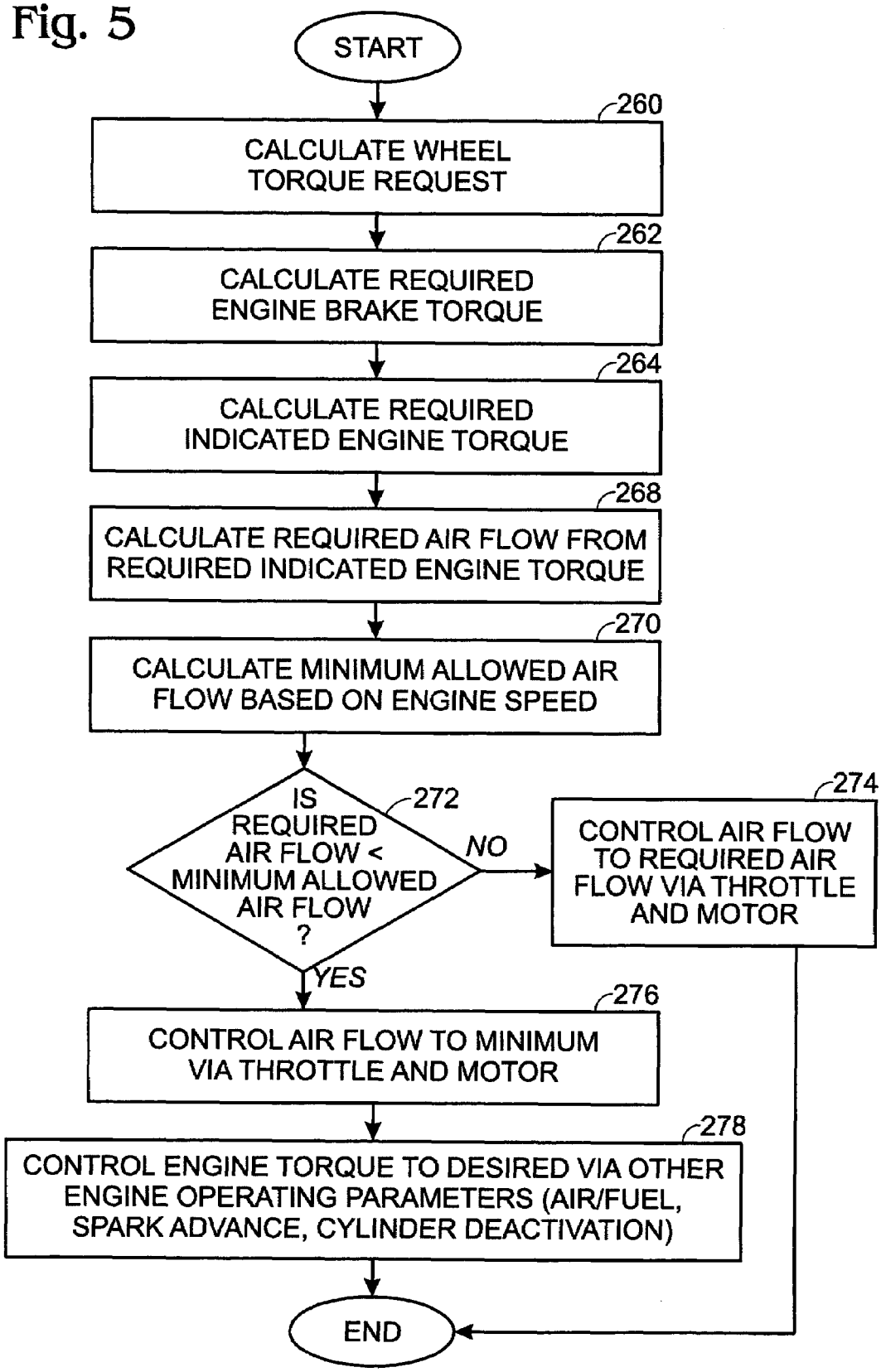

In FIG. 5, the torque control logic is executed. The primary inputs for this feature include the vehicle speed, pedal position, and the status of the command switches for the cruise control, traction control, and gear position. The primary purpose of step 260 is to calculate an absolute wheel torque request (as opposed to a limit or maximum torque request). The value of the wheel torque request parameter represents the torque computed by the controller which should be delivered to the driven wheel of the vehicle to meet the driver request, or maintain or resume the desired vehicle speed, or reduce wheel slippage, etc.

Required brake engine torque is calculated in step 262 from required wheel torque, axle ratio, gear ratio, torque converter speed ratio (if unlocked), and an estimate of the mechanical efficiency is calculated. Required indicated engine torque is calculated in step 264 from brake engine torque plus friction torque where friction torque is calculated as is known in the art.

Continuing with FIG. 5, this indicated torque is adjusted for spark retard from MBT (maximum timing for best torque) and air/fuel deviations from stoichiometric to standardize the value before table look-up. The standardized indicated torque is entered into a table with engine speed to determine required air mass flow in step 268. Then, in step 270, the minimum allowable airflow is calculated based on engine speed. This minimum allowable airflow represents the minimum airflow at which the engine can operate without misfires while retarding ignition timing, and/or operating lean, and/or deactivating cylinders. These values are typically determined during steady state engine mapping. Then, in step 272 a determination is made as to whether the required air mass flow from step 268 is less than the minimum allowable airflow from step 270. When the required air mass flow is not less than the minimum allowable airflow the airflow request, used for controlling the throttle, is set to the required air mass flow in step 274. In this way, engine torque is controlled to the desired engine torque.

Continuing with FIG. 5, when the required air mass flow is less than the minimum allowable airflow then airflow is controlled to the minimum allowable airflow in step 276 using the throttle, wherein the airflow request is set to the minimum allowable airflow. Then, in step 278, engine torque is controlled via a combination of cylinder deactivation, air/fuel ratio, and spark timing as is known in the art. Also, additional parameters can be used for controlling engine torque, such as, for example, variable cam timing, exhaust gas recirculation, or any other parameter that affects engine torque known to those skilled in the art and suggested by this disclosure.

Figure 6:
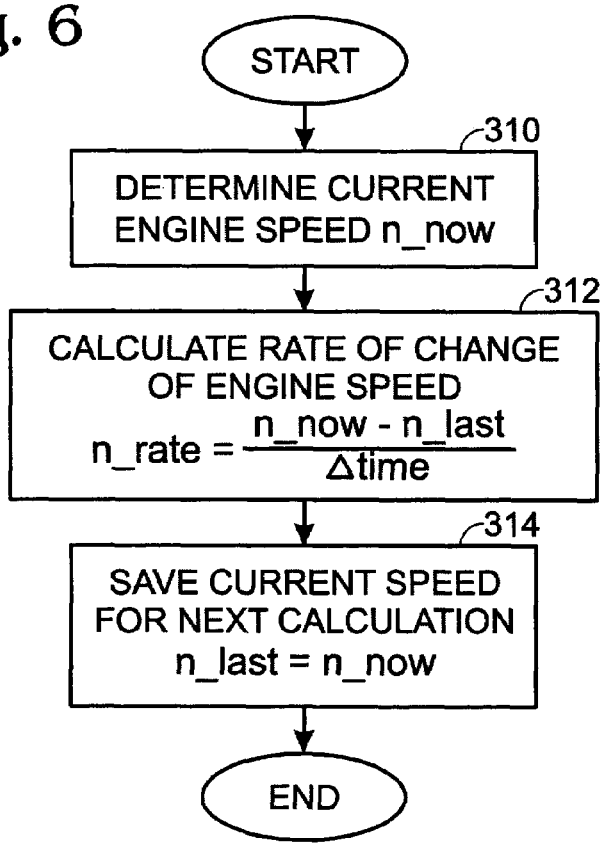
FIGS. 6 and 7 are exemplary routines for re-enabling fuel cut out operation.

Referring now to FIG. 6, a routine is described for calculating a rate of change of engine speed. First, in step 310, the routine determines the current engine speed (n_now). The current engine speed can be calculated based on an engine speed sensor, or estimated based on vehicle speed and gear ratio. Next, in step 312, the routine calculates a rate of change of engine speed (n_rate). The rate of change of engine speed can be calculated in various ways, for example, based on the difference between the current engine speed and a previously calculated engine speed divided by the time between calculations. In another example, an approximate derivative can be generated using a high pass filter of the lip loss form $(s/(\tau s+1))$, where $\tau$ is significantly smaller than 1. Further, various other algorithms can be used to calculate a rate of change.

In this embodiment, a rate of change of engine speed with respect to time is calculated, and used with a corresponding required time to reactivate an engine cylinder as described below and herein with particular reference to FIG. 7. Note however, that various other durations can be utilized. In one example alternative embodiment a rate of change of engine speed in the engine event domain is utilized. In this case, the change in measured engine speed over a given number of engine events (e.g. every engine firing) is calculated as the current engine speed at the current engine event minus the engine speed at the previous engine event. In another alternative example, the change in engine speed over a given number of engine firings can be utilized. Still other examples can be used such as, the change in engine speed over a given number of engine revolutions.

Finally, continuing with FIG. 6, in step 314 the routine saves the current speed for the next loop through the calculations by setting the current engine speed to the previous engine speed (n_last). In this way, the routine can calculate a rate of change of engine speed to be utilized in determining whether to reactivate engine cylinders as described below herein with particular reference to FIG. 7.

Referring now to FIG. 7, a routine is described for determining whether to enable the deactivated engine cylinders based on a predicted engine speed and a minimum allowable engine speed. First, in step 410, the routine calculates a required time to start (TTSWEB) and a minimum starting speed (MSSWEB) for engine braking conditions. This minimum time to start the engine (or cylinder) and minimum rotating engine speed are calculated based on various operating conditions such as, for example: engine coolant temperature, air charge temperature, the size of the fuel puddle that is estimated to be in the intake manifold, and various other conditions. Next, in step 412, the routine calculates the minimum required time to start the engine (or a cylinder) (TTSWOEB), and the minimum starting speed (MSSWOEB) without engine braking. Again, these values are calculated based on operating conditions, such as, for example: engine coolant temperature, air charge temperature, and fuel puddle size.

As described above, the required starting time, and an alternative embodiment, can be a required number of engine events. In other words, the duration required to start the engine (or a cylinder, or a group of cylinders) can be an amount of time, a number of engine events, a number of engine revolutions, a number of engine firings, or various other durations. Also note that there are various types of engine braking that can be considered. For example, engine braking can include whether a manual clutch of a manual transmission is engaged or disengaged, whether the current gear in an automatic transmission has an overrunning clutch, or whether the torque converter of an automatic transmission allows transmission input to overrun the engine input.

Continuing with FIG. 7, in step 414 the routine determines whether the current vehicle conditions are ones where engine braking is present. As described above, there are various conditions which can create engine braking, or can create partial engine braking. When the answer to step 414 is "no", the routine continues to step 416. In step 416 the routine sets the required duration to start, in this example a timed start, (TTS) to TTSWOEB as calculated in step 412. Next, in step 418 the routine sets the minimum starting speed (MSS) to MSSWOEB as calculated in step 412.

When the answer to step 414 is "yes", the routine continues to steps 420 and 422. In steps 420 and 422, the routine sets the time to start (TTS) to TTSWEB as determined in step 410, and sets the minimum starting speed (MSS) to MSSWEB as determined in step 410.

Next, in step 424 (from either steps 418 or 422) the routine predicts a future engine speed that will occur after the time to start has elapsed. This predicted future speed (n_future) is determined by subtracting the calculated rate of engine speed in step 312 times the time to start (from either steps 416 or 420 depending on whether engine braking is present), and subtracting this value from the current engine speed.

Then, in step 426, the routine compares the predicted future speed to the minimum starting speed (MSS) and determines whether to require enablement of deactivated cylinders. Specifically, when the future engine speed is less than the minimum starting speed, the routine has determined that if conditions continue as they are (i.e., engine continues at the current rate of change) then by the time the engine tries to start, an engine stall can occur. Therefore, in step 428, the routine sets an enable flag to require enablement of engine cylinders so that the engine can be started before the engine speed falls below the minimum starting speed. Alternatively, when the answer to step 426 is "no", the routine simply continues to allow the current fuel cut state to continue.

In this way, the routine allows more reliable engine reactivation from the fuel cut state.

This concludes the description of the invention. The reading of it by those skilled in the art would bring to mind many alterations and modifications without departing from the spirit and the scope of the invention. Accordingly, it is intended that the scope of the invention be defined by the following claims:

We claim:

1. A method for controlling an engine of a powertrain in a vehicle on the road, the method comprising:

deactivating fuel injection to at least one engine cylinder based at least on a vehicle operating condition;

determining a duration required for reactivating at least said at least one engine cylinder;

determining a minimum engine speed value based on an operating parameter; and reactivating at least said at least one engine cylinder based at least on said duration, wherein said reactivating is further based on a comparison of said minimum engine speed with a predicted future engine speed based on said duration.

2. The method of claim 1, wherein said operating parameter is whether the vehicle's powertrain is in an engine braking conditions.

3. The method of claim 2, wherein said engine braking condition is determined based on whether the engine can be driven by the road through the powertrain.

4. The method of claim 1, wherein said duration is an amount of time.

5. The method of claim 1, wherein said duration is a number of engine cycles.

6. The method of claim 1, wherein said duration is a number of engine events.

7. The method of claim 1, wherein said predicted future engine speed is predicted based on said duration.

8. The method of claim 1, wherein said vehicle operating condition is a requested engine torque.

9. The method of claim 1, wherein said vehicle operating condition is a vehicle speed.

10. The method of claim 1, wherein said vehicle operating condition is a rate of change of vehicle speed.

11. The method of claim 1, wherein all cylinders of the engine are disabled and reactivated together.

12. A method for controlling an engine of a powertrain in a vehicle on the road, the method comprising;

deactivating fuel injection to at least one engine cylinder based at least on a vehicle operating condition;

determining a duration required for reactivating at least said at least one engine cylinder;

determining a minimum engine speed value based on an operating parameter;

calculating an engine speed after said duration based on a rate of change of engine speed; and reactivating at least said at least one engine cylinder based at least on a comparison of said calculated engine speed and said determined minimum engine speed.

13. The method of claim 12, wherein said operating parameter is whether the vehicle's powertrain is in an engine braking conditions.

14. The method of claim 13, wherein said engine braking condition is determined based on whether the engine can be drived by the mad through the powertrain.

15. The method of claim 12, wherein said duration is an amount of time.

16. The method of claim 12, wherein said duration is a number of engine cycles.

17. The method of claim 12, wherein said duration is a number of engine events.

18. A computer storage medium having instructions encoded therein for controlling an engine of a powerirain in a vehicle on the road, said medium comprising:

code for deactivating fuel injection to at least one engine cylinder based at least on a vehicle operating condition;

code for determining a duration required for reactivating at least said at least one engine cylinder;

code for determining a rate of change of engine speed; and code for reactivating at least said at least one engine cylinder based at least on said rate of change of engine speed and said duration.

19. The medium of claim 18, wherein said code for reactivating further comprises code for reactivating at least said at least one engine cylinder based at least on a predicted future engine speed calculated based on said rate of change of engine speed and said duration with a minimum allowable engine speed.

* * * * *